US005844580A

United States Patent [19]

Barinaga et al.

[11] Patent Number: 5,844,580

[45] Date of Patent: Dec. 1, 1998

[54] INK CONTAINER CONFIGURED FOR USE WITH A PRINTING DEVICE HAVING AN OUT-OF-INK SENSING SYSTEM

[76] Inventors: John A. Barinaga, 2041 NW. 29th Ave., Apt. #2, Portland, Oreg. 97210; John A. Underwood, 3415 NE. 113th St., Vancouver, Wash. 98686; James Cameron, 1600 NW. 32nd Ave., Portland, Oreg. 97210; Winthrop D. Childers, 17015 Oculto Ct., San Diego, Calif. 92127

[21] Appl. No.: 869,151

[22] Filed: Jun. 4, 1997

Related U.S. Application Data

[63] Continuation-in-part of Ser. No. 566,819, Dec. 4, 1995, abandoned.

[51] Int. Cl.[6] ..... B41S 2/195; B41S 2/175

[52] U.S. Cl. ..... 347/7; 347/86

[58] Field of Search ..... 347/7, 85–87

[56] References Cited

U.S. PATENT DOCUMENTS

| | | | |
|---|---|---|---|
| 4,178,595 | 12/1979 | Jinnai | 347/7 |
| 4,187,511 | 2/1980 | Robinson | 347/7 |
| 4,342,042 | 7/1982 | Cruz-Uribe | 347/7 |
| 4,380,772 | 4/1983 | Italiano | 347/7 |
| 4,422,084 | 12/1983 | Saito | 347/7 |
| 4,604,633 | 8/1986 | Kimura | 347/7 |
| 4,610,202 | 9/1986 | Ebimura | 101/364 |
| 4,636,814 | 1/1987 | Terasawa | 347/86 |
| 4,639,738 | 1/1987 | Young | 347/89 |
| 4,680,696 | 7/1987 | Ebinuma | 347/85 |
| 4,709,246 | 11/1987 | Piatt et al. | 347/40 |
| 4,714,937 | 12/1987 | Kaplinsky | 347/86 |
| 4,719,475 | 1/1988 | Kiyohara | 347/7 |
| 4,736,213 | 4/1988 | Piatt et al. | 360/105 |
| 4,935,751 | 6/1990 | Hamlin | 347/86 |
| 4,940,997 | 7/1990 | Hamlin et al. | 347/87 |
| 4,973,993 | 11/1990 | Allen | 347/7 |
| 4,977,413 | 12/1990 | Yamanaka | 347/7 |
| 4,992,802 | 2/1991 | Dion | 347/7 |
| 5,136,305 | 8/1992 | Ims | 347/7 |
| 5,136,309 | 8/1992 | Lida | 347/7 |
| 5,187,498 | 2/1993 | Burger | 347/86 |
| 5,206,668 | 4/1993 | Lo et al. | 347/6 |
| 5,359,353 | 10/1994 | Hunt | 347/86 |
| 5,574,484 | 11/1996 | Cowger | 347/7 |
| 5,583,545 | 12/1996 | Pawlowski, Jr. et al. | 347/7 |
| 5,729,256 | 3/1998 | Yamanaka et al. | 347/7 |

FOREIGN PATENT DOCUMENTS

| | | |
|---|---|---|
| 60056561 | 2/1985 | European Pat. Off. . |
| 0684139 A1 | 2/1991 | European Pat. Off. . |

*Primary Examiner*—Benjamin R. Fuller
*Assistant Examiner*—Craig A. Hallacher
*Attorney, Agent, or Firm*—Kevin B. Sullivan

[57] ABSTRACT

The present invention is a replaceable ink container for use with a printing apparatus. The printing apparatus of the type having out of ink detection. The replaceable ink container includes a fluid reservoir having an outlet. The outlet is configured for connection to a fluid inlet associated with the printing apparatus. Also included in the replaceable ink container is an actuator engagement device for engaging an actuator associated with the printing apparatus. The actuator is of the type that is movable between a first position wherein an out of ink signal is generated and a second position. The actuator engagement device is disposed and arranged to engage the actuator to prevent movement of the actuator from the second position to the first position thereby preventing the out of ink signal.

23 Claims, 7 Drawing Sheets

INK CONTAINER CONFIGURED FOR USE WITH A PRINTING DEVICE HAVING AN OUT-OF-INK SENSING SYSTEM

CROSS-REFERENCES TO RELATED APPLICATIONS

This application is a continuation-in-part of commonly assigned U.S. patent application Ser. No. 08/566,819 now abandoned entitled "Out of Ink Sensing System for an Ink Jet Printer", filed on Dec. 4, 1995.

BACKGROUND OF THE INVENTION

The present invention relates to an ink supply for an ink-jet printer and, more particularly, to a replaceable ink supply configured for use with an ink-jet printer having an actuator configured for engaging a pump portion for supplying ink from an ink container to an ink-jet printhead.

Ink-jet printers frequently make use of a print head mounted to a carriage which is moved back and forth over a print media, such as paper. As the print head passes over appropriate locations on the print media, a control system activates the print head to deposit ink drops onto the printing surface to form images and text.

One type of ink jet printing system disclosed in co-pending patent application, Ser. No. 08/566,819 entitled "Out-of-Ink Sensing System for an Ink-Jet Printer" to Barinaga et al, filed on Dec. 4, 1995, assigned to the assignee of the present invention and incorporated herein by reference, discloses the use of a replaceable ink container that is mounted off the scanning carriage. The ink container is in fluid communication with the print head that is mounted on the scanning carriage. The ink container includes a variable volume chamber and a reservoir for providing ink to the variable volume chamber. An actuator, associated with the printing device, engages the variable volume chamber to force ink from the variable volume chamber to the printing device.

An out of ink sensing technique is used to determine the if the reservoir is out of ink based on ink in the variable volume chamber. The out of ink sensing technique makes use of actuator displacement to determine if a low ink condition exists in the variable volume chamber. A sensor is used to determine the displacement of the actuator.

There is an ever present need for ink container that are relatively inexpensive and are capable of reliably providing ink to the print head. These ink containers should be well suited to high volume manufacturing techniques as well as make together with the printer provide a reliable technique for determining an out of ink condition for preventing damage to the print head.

SUMMARY OF THE INVENTION

The present invention is a replaceable ink container for use with a printing apparatus. The printing apparatus of the type having out of ink detection. The replaceable ink container includes a fluid reservoir having an outlet. The outlet is configured for connection to a fluid inlet associated with the printing apparatus. Also included in the replaceable ink container is an actuator engagement device for engaging an actuator associated with the printing apparatus. The actuator is of the type that is movable between a first position wherein an out of ink signal is generated and a second position. The actuator engagement device is disposed and arranged to engage the actuator to prevent movement of the actuator from the second position to the first position thereby preventing the out of ink signal.

DETAILED DESCRIPTION OF THE PREFERRED EMBODIMENT

Figure 1:
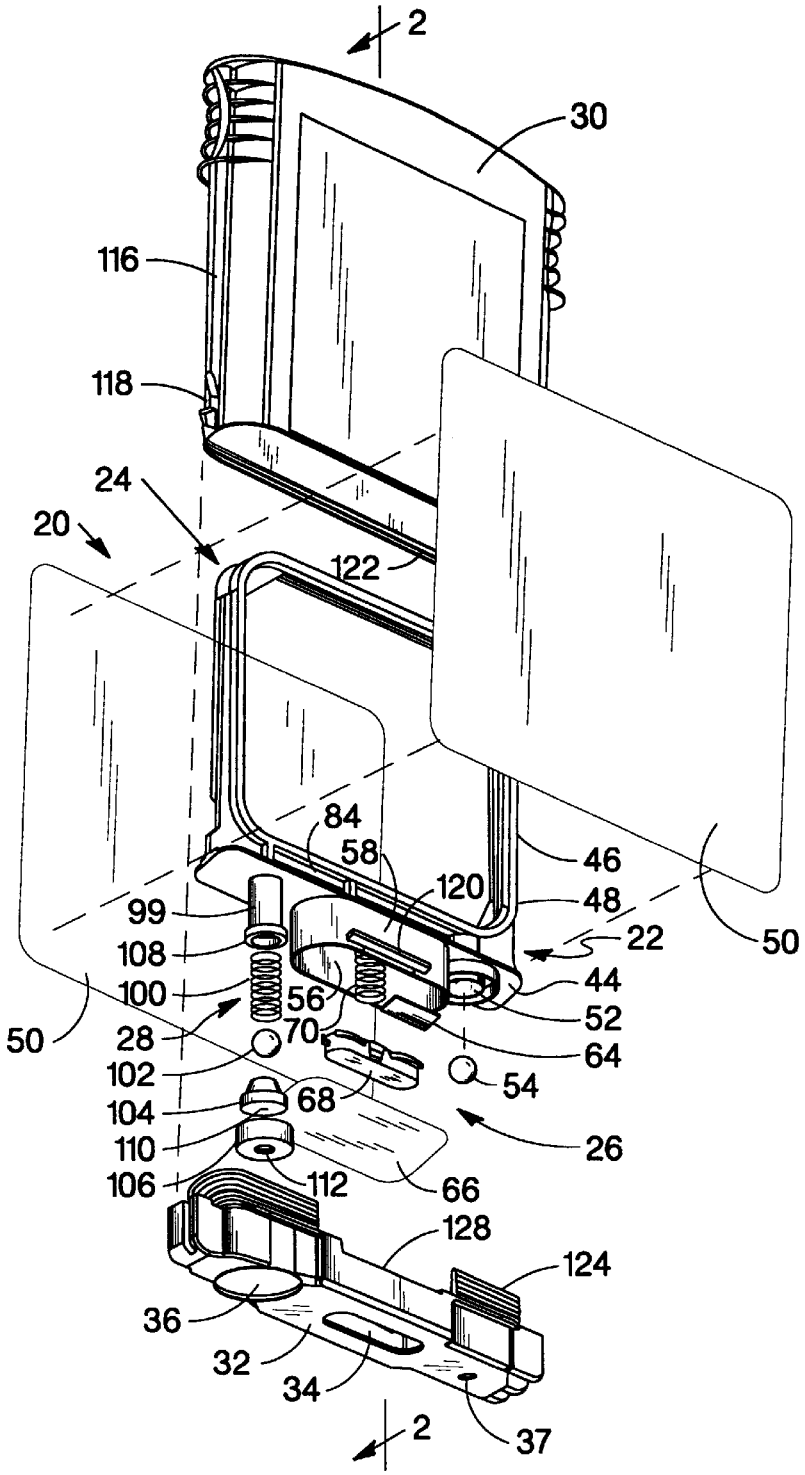
FIG. 1 is an exploded view of an ink supply of the present invention that includes a variable volume chamber for providing ink to a printing system.

As discussed in co-pending patent application Ser. No. 08/566,819 the ink supply of the type having a variable volume chamber or diaphragm pump is illustrated in FIG. 1 as reference numeral 20. The ink supply 20 includes a chassis 22 which carries an ink reservoir 24 for containing ink, a pump 26 and fluid outlet 28. The chassis 22 is enclosed within a hard protective shell 30 having a cap 32 affixed to its lower end. The cap 32 is provided with an aperture 34 to allow access to the pump 26 and an aperture 36 to allow access to the fluid outlet 28.

Figure 2:
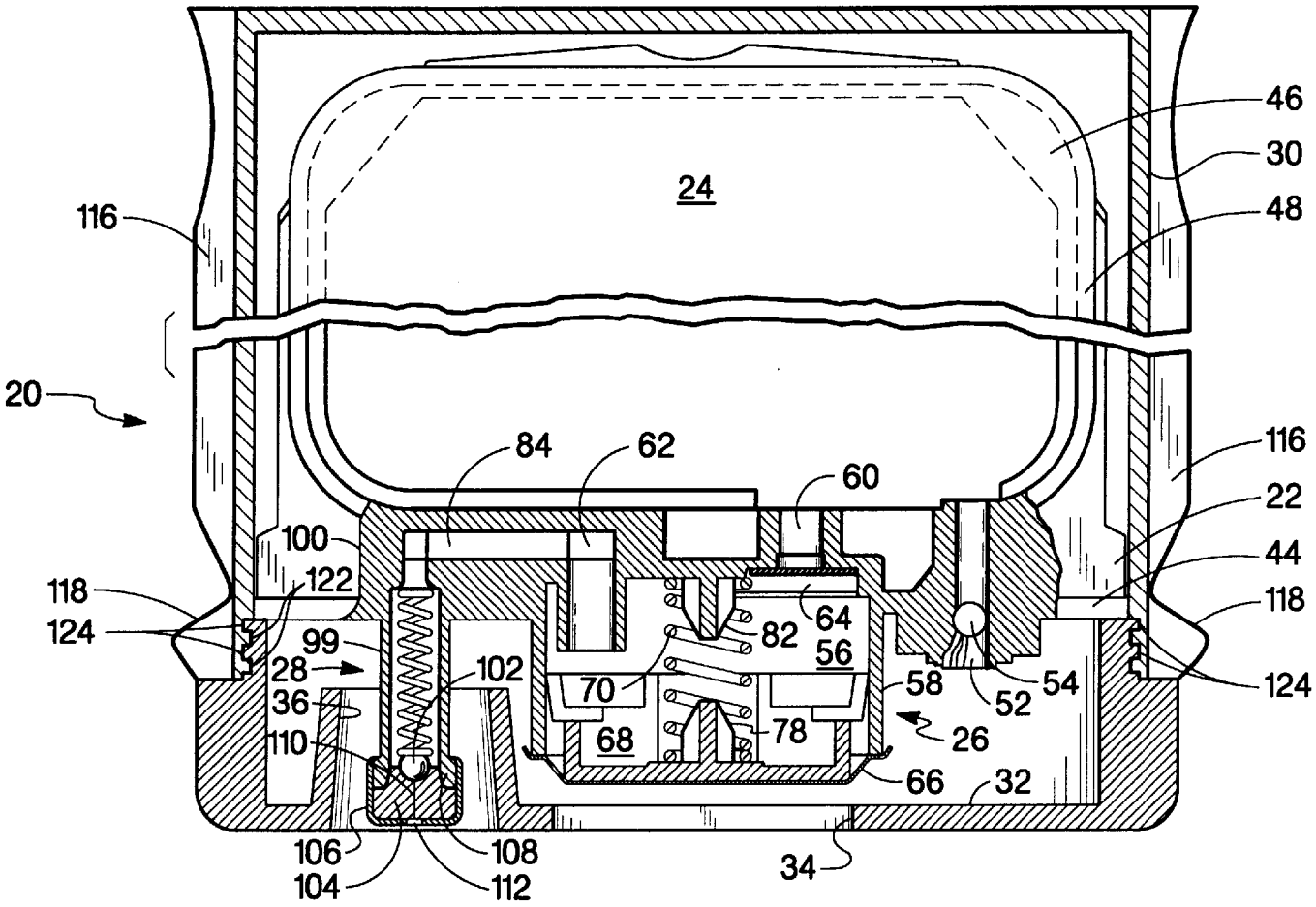
FIG. 2 is cross sectional view, taken along line 2—2 of FIG. 1, of a portion of the ink supply of FIG. 1.

As illustrated in FIGS. 1 and 2, the chassis 22 has a main body 44. Extending upward from the top of the chassis body 44 is a frame 46 which helps define and support the ink reservoir 24. In the illustrated embodiment, the frame 46 defines a generally square reservoir 24 having a thickness determined by the thickness of the frame 46 and having open sides. Each side of the frame 46 is provided with a face 48 to which a sheet of plastic 50 is attached to enclose the sides of the reservoir 24. The illustrated plastic sheet is flexible to allow the volume of the reservoir to vary as ink is depleted from the reservoir. This assists in emptying the reservoir by reducing the amount of backpressure created as ink is depleted from the reservoir.

The body 44 of the chassis 22, as seen in FIGS. 1 and 2, is provided with a fill port 52 to allow ink to be introduced into the reservoir. After filling the reservoir, a plug 54 such as a polypropylene ball is inserted into the fill port 52 to prevent the escape of ink through the fill port.

A pump 26 is carried on the body 44 of the chassis 22. The pump 26 serves to pump ink from the reservoir and supply it to the printer via the fluid outlet 28. In the illustrated embodiment, seen in FIGS. 1 and 2, the pump 26 includes a pump chamber 56 that is integrally formed with the chassis 22. The pump chamber is defined by a skirt-like wall 58 which extends downwardly from the body 44 of the chassis 22.

A pump inlet 60 is formed at the top of the chamber 56 to allow fluid communication between the chamber 56 and the ink reservoir 24. A pump outlet 62 through which ink may be expelled from the chamber 56 is also provided. A valve 64 is positioned within the pump inlet 60. The valve 64 allows the flow of ink from the ink reservoir 24 into the chamber 56 but limits the flow of ink from the chamber 56 back into the ink reservoir 24. In this way, when the chamber is depressurized, ink may be drawn from the ink reservoir, through the pump inlet and into the chamber. When the chamber is pressurized, ink within the chamber may be expelled through the pump outlet.

In the illustrated embodiment, the valve 64 is a flapper valve positioned at the bottom of the pump inlet. The flapper valve 64 illustrated in FIGS. 1 and 2, is a rectangular piece of flexible material. The valve 64 is positioned over the bottom of the pump inlet 60 and heat staked to the chassis 22 at the midpoints of its short sides (the heat staked areas are darkened in the Figures). When the pressure within the chamber drops sufficiently below that in the reservoir, the unstaked sides of the valve each flex downward to allow the flow of ink around the valve 64, through the pump inlet 60 and into the chamber 56.

A flexible diaphragm 66 encloses the bottom of the chamber 56. The diaphragm 66 is slightly larger than the opening at the bottom of the chamber 56 and is sealed around the bottom edge of the wall 58. The excess material in the oversized diaphragm allows the diaphragm to flex up and down to vary the volume within the chamber.

A pressure plate 68 and a spring 70 are positioned within the chamber 56. The pressure plate 68 has a smooth lower face 72 with a wall 74 extending upward about its perimeter. The central region 76 of the pressure plate 68 is shaped to receive the lower end of the spring 70 and is provided with a spring retaining spike 78. Four wings 80 extend laterally from an upper portion of the wall 74.

The pressure plate 68 is positioned within the chamber 56 with the lower face 72 adjacent the flexible diaphragm 66. The upper end of the spring 70, which is stainless steel in the illustrated embodiment, is retained on a spike 82 formed in the chassis and the lower end of the spring 70 is retained on the spike 78 on the pressure plate 68. In this manner, the spring biases the pressure plate downward against the diaphragm to increase the volume of the chamber. The wall 74 and wings 80 serve to stabilize the orientation of the pressure plate while allowing for its free, piston-like movement within the chamber 56. The structure of the pressure plate, with the wings extending outward from the smaller face, provides clearance for the heat stake joint between the diaphragm and the wall and allows the diaphragm to flex without being pinched as the pressure plate moves up and down. The wings are also spaced to facilitate fluid flow within the pump.

As illustrated in FIG. 2, a conduit 84 joins the pump outlet 62 to the fluid outlet 28. In the illustrated embodiment, the top wall of the conduit 84 is formed by the lower member of the frame 46, the bottom wall is formed by the body 44 of the chassis, one side is enclosed by a portion of the chassis and the other side is enclosed by a portion of one of the plastic sheets 50.

As illustrated in FIGS. 1 and 2, the fluid outlet 28 is housed within a hollow cylindrical boss 99 that extends downward from the chassis 22. The top of the boss 99 opens into the conduit 84 to allow ink to flow from the conduit into the fluid outlet. A spring 100 and sealing ball 102 are positioned within the boss 99 and are held in place by a compliant septum 104 and a crimp cover 106. The crimp cover 106 fits over the septum 104 and engages an annular projection 108 on the boss 99 to hold the entire assembly in place.

The reservoir 24 is enclosed within a protective shell 30. A protective cap 32 is fitted to the bottom of the shell 30 to maintain the chassis 22 in position. The cap 32 is provided with recesses 128 which receive the stops 120 on the chassis 22. In this manner, the stops are firmly secured between the cap and the shell to maintain the chassis in position. The cap is also provided with an aperture 34 to allow access to the pump 26 and with an aperture 36 to allow access to the fluid outlet 28.

In the illustrated embodiment, the bottom of the shell 30 is provided with two circumferential grooves 122 which engage two circumferential ribs 124 formed on the cap 32 to secure the cap to the shell. Sonic welding or some other mechanism may also be desirable to more securely fix the cap to the shell.

As represented in FIGS. 3A–3E the ink supply 20 is inserted into a docking bay of an ink-jet printer. Upon insertion of the ink supply 20, an actuator 40 within the docking bay is brought into contact with the pump 26 through aperture 34. In addition, a fluid inlet (not shown) within the docking bay is coupled to the fluid outlet 28 to create a fluid path from the ink supply to the printer. Operation of the actuator 40 causes the pump 26 to draw Ink from the reservoir 24 and supply the ink through the fluid outlet 28 and the fluid inlet associated with the printer.

The upper end of the actuator 40 extends upward through a base plate (not shown) in the docking bay. The lower portion of the actuator 40 is positioned below the base plate and is pivotably coupled to one end of a lever 152 which is supported on pivot point 154. The other end of the lever 154 is biased downward by a compression spring 156. In this manner, the force of the compression spring 156 urges the actuator 40 upward. A cam 158 mounted on a rotatable shaft 160 is positioned such that rotation of the shaft to an engaged position causes the cam to overcome the force of the compression spring 156 and move the actuator 40 downward. Movement of the actuator, as explained in more detail below, causes the pump 26 to draw ink from the reservoir 24 and supply it through the fluid outlet 28 and the fluid inlet associated with the printer.

As illustrated in FIGS. 3A–3E, a flag 184 extends downward from the bottom of the actuator 40 where it is received within an optical detector 186. The optical detector 186 is of conventional construction and directs a beam of light from one leg toward a sensor (not shown) positioned on the other leg. The optical detector is positioned such that when the actuator 40 is in its uppermost position, corresponding to the top of the pump stroke, the flag 184 raises above the beam of light allowing it to reach the sensor and activate the detector. In any lower position, the flag blocks the beam of light and prevents it from reaching the sensor and the detector is in a deactivated state. In this manner, the sensor can be used, as explained more fully below, to control the operation of the pump and to detect when an ink supply is empty.

Figure 3A:
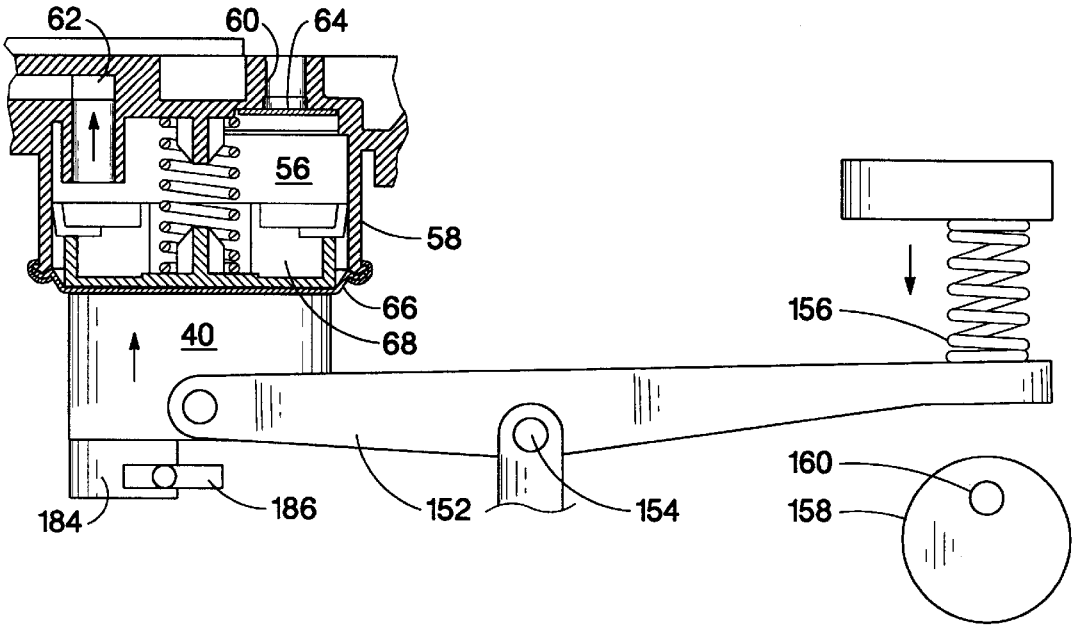
FIGS. 3A–3E are cross sectional views of a portion of the ink supply and docking bay showing the pump, actuator and out-of-ink detector in various stages of operation.

FIG. 3A illustrates the fully charged position of the pump 26. The flexible diaphragm 66 is in its lowermost position, the volume of the chamber 56 is at its maximum, and the flag 184 is blocking the light beam from the sensor. The actuator 40 is pressed against the diaphragm 66 by the compression spring 156 to urge the chamber to a reduced volume and create pressure within the pump chamber 56. As the valve 64 limits the flow of ink from the chamber back into the reservoir, the ink passes from the chamber through the pump outlet 62 and the conduit 84 to the fluid outlet 28.

Figure 3B:
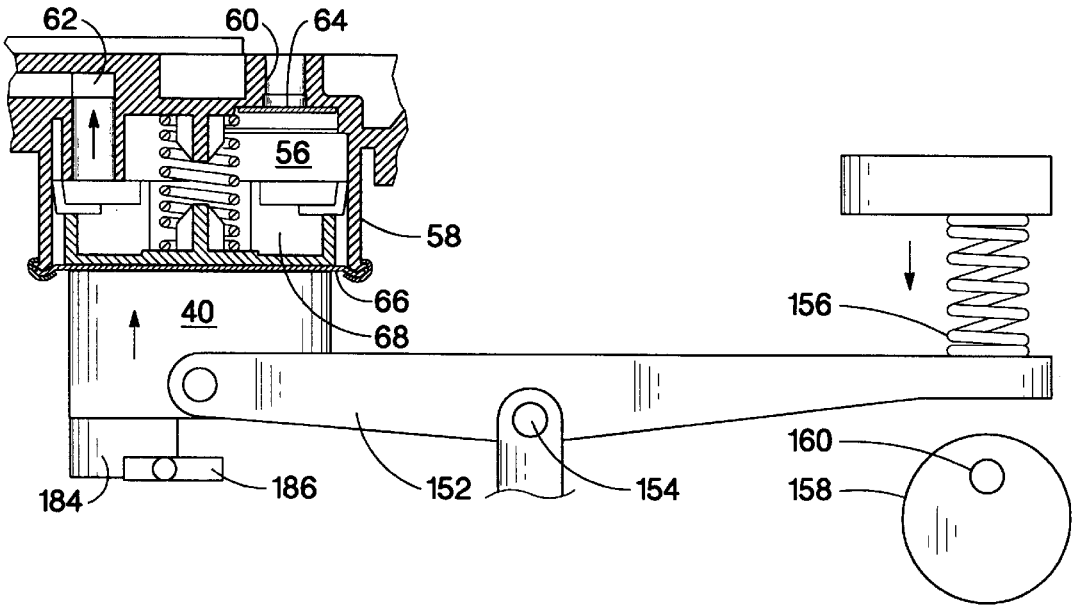

As ink is depleted from the pump chamber 56, the compression spring 156 continues to press the actuator 40 upward against the diaphragm 66 to maintain a pressure within the pump chamber 56. This causes the diaphragm to move upward to an intermediate position decreasing the volume of the chamber, as illustrated in FIG. 3B. In the intermediate position, the flag 184 continues to block the beam of light from reaching the sensor in the optical detector 186.

Figure 3C:
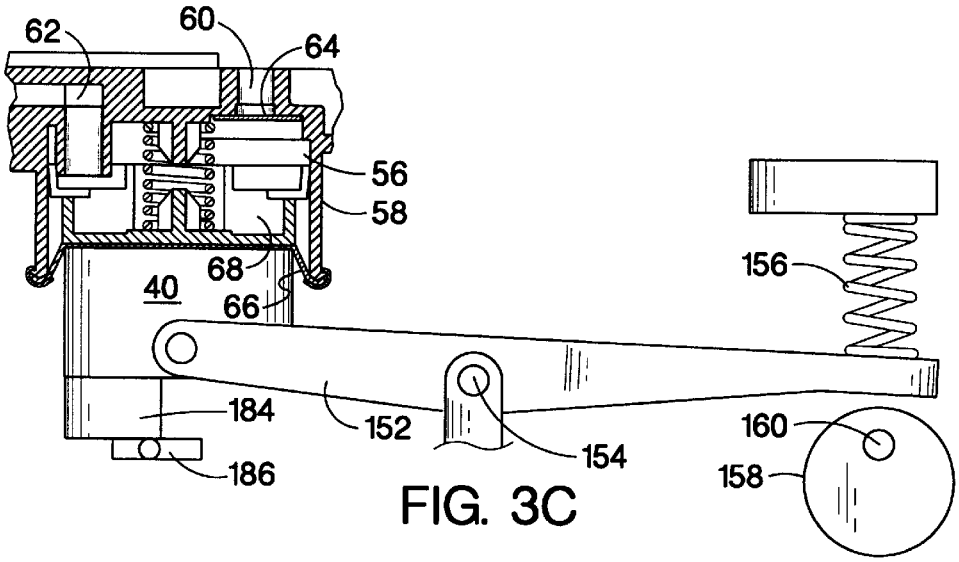

As still more ink is depleted from the pump chamber 56, the diaphragm 40 is pressed to its uppermost position, illustrated in FIG. 3C. In the uppermost position, the volume of the chamber 56 is at its minimum operational volume and the flag 184 rises high enough to allow the light beam to reach the sensor and activate the optical detector.

Figure 3D:
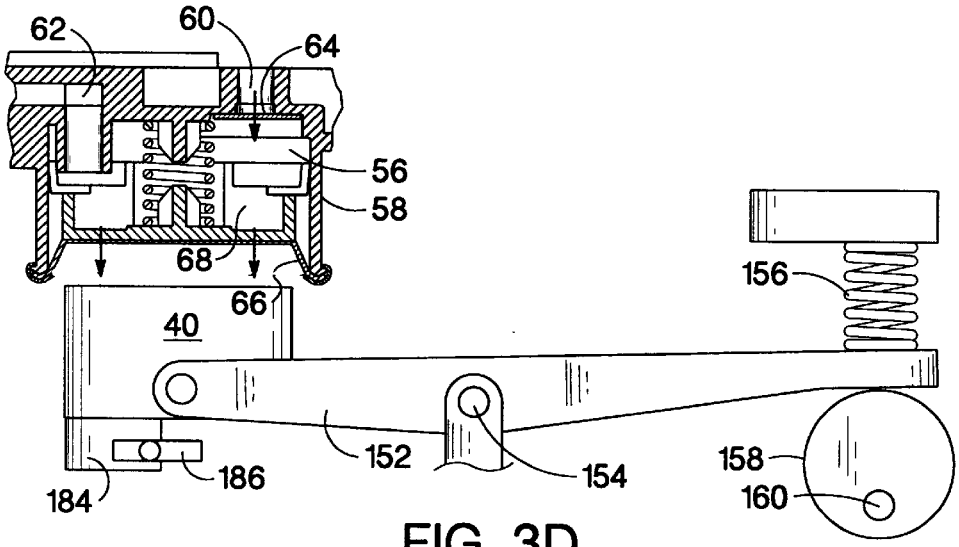

The printer control system (not shown) detects activation of the optical detector 186 and begins a refresh cycle. As illustrated in FIG. 3D, during the refresh cycle the cam 158 is rotated into engagement with the lever 152 to compress the compression spring 156 and move the actuator 40 to its lowermost position. In this position, the actuator 40 does not contact the diaphragm 66.

Figure 3E:
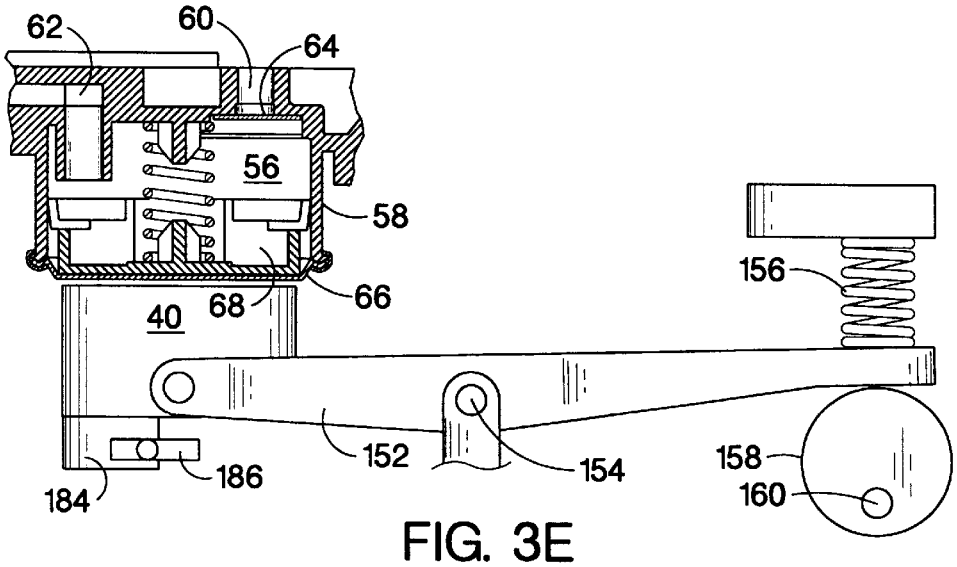

With the actuator 40 no longer pressing against the diaphragm 66, the pump spring 70 biases the pressure plate 68 and diaphragm 66 outward, expanding the volume and decreasing the pressure within the chamber 56. The decreased pressure within the chamber 56 allows the valve 64 to open and draws ink from the reservoir 24 into the chamber 56 to refresh the pump 26, as illustrated in FIGS. 3D and 3E. The check valve at the print head, the flow resistance within the trailing tube, or both will limit ink from returning to the chamber 56 through the conduit 84. Alternatively, a check valve may be provided at the outlet port, or at some other location, to prevent the return of ink through the outlet port and into the chamber.

After a predetermined amount of time has elapsed, the refresh cycle is concluded by rotating the cam 158 back into its disengaged position and the ink supply typically returns to the configuration illustrated in FIG. 3A.

However, if the ink supply is out of ink, no ink can enter into the pump chamber 56 during a refresh cycle. In this case, the backpressure within the ink reservoir 24 will prevent the chamber 56 from expanding. As a result, when the cam 158 is rotated back into its disengaged position, the actuator 40 returns to its uppermost position, as illustrated in FIG. 3C, and the optical detector 186 is again activated. Activation of the optical detector immediately after a refresh cycle, informs the control system that the ink supply is out of ink (or possibly that some other malfunction is preventing the proper operation of the ink supply). In response, the control system can generate a signal informing the user that the ink supply requires replacement.

Another embodiment of the ink container of the present invention is represented by an ink container 20' shown in FIGS. 4, 5, and 6A–C. The ink container 20' is a non-pressurized ink container that is configured for use with a printing device having an out of ink sensing system based on actuator displacement. Similar numbering will be used to identify structures of ink container 20' which are similar to structures disclosed in ink container 20 previously discussed. Moreover, similar features in ink container 20' of the present invention will not be discussed in detail because similar structures have been described in detail with respect to ink container 20 discussed previously.

Ink container 20' of the present invention is similar to the ink container 20 discussed previously except that the pump 26 has been eliminated and the cap 32 has been modified to engage the actuator 40 for preventing an out of ink signal based on actuator position, as will be discussed in detail later. Instead an out of ink condition can then be determined using other methods such as drop counting or ink usage.

Figure 4:
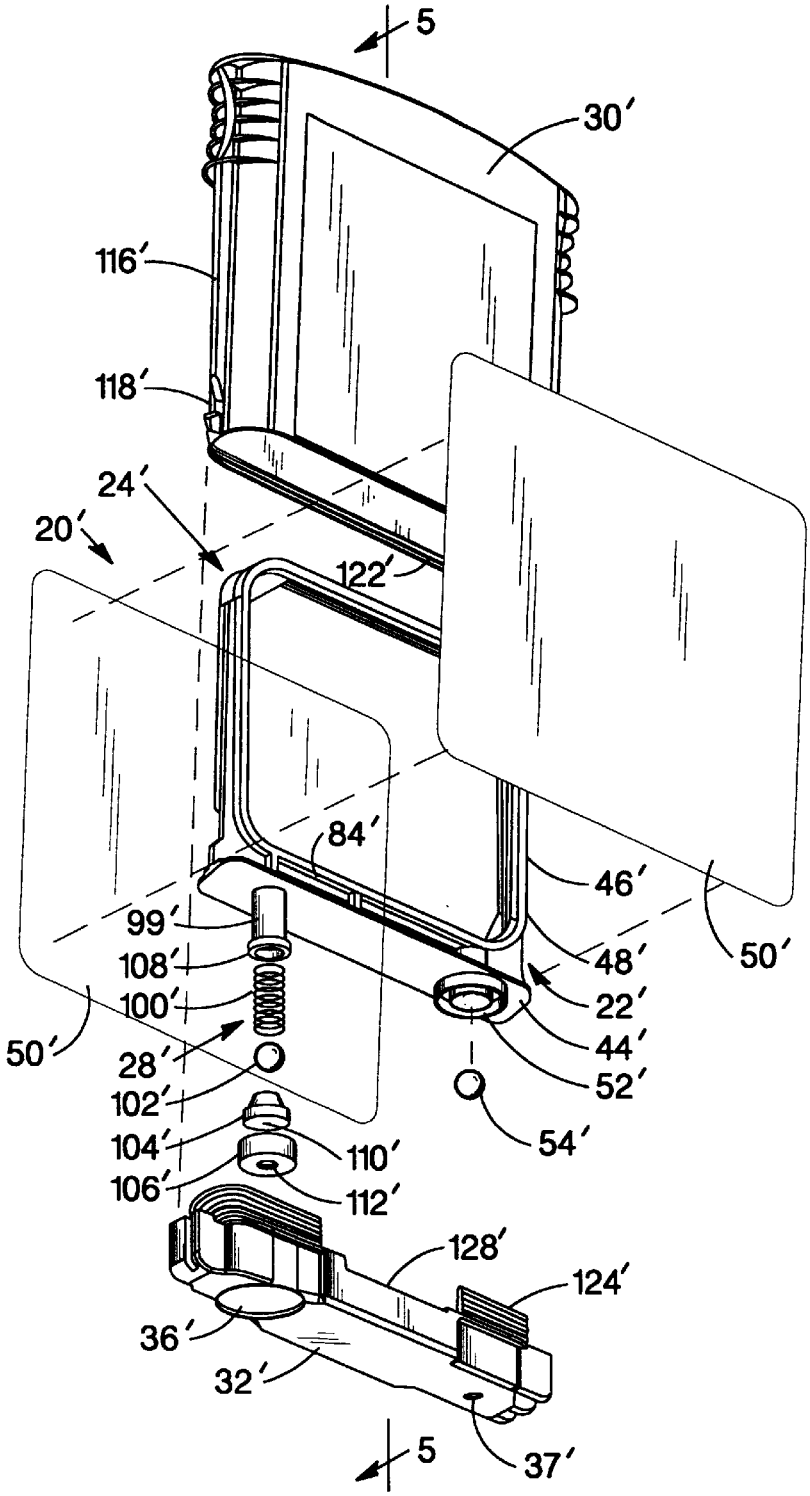
FIG. 4 is an exploded view of a non-pressurized ink supply of the present invention for use with the printing system having an actuator.
Figure 5:
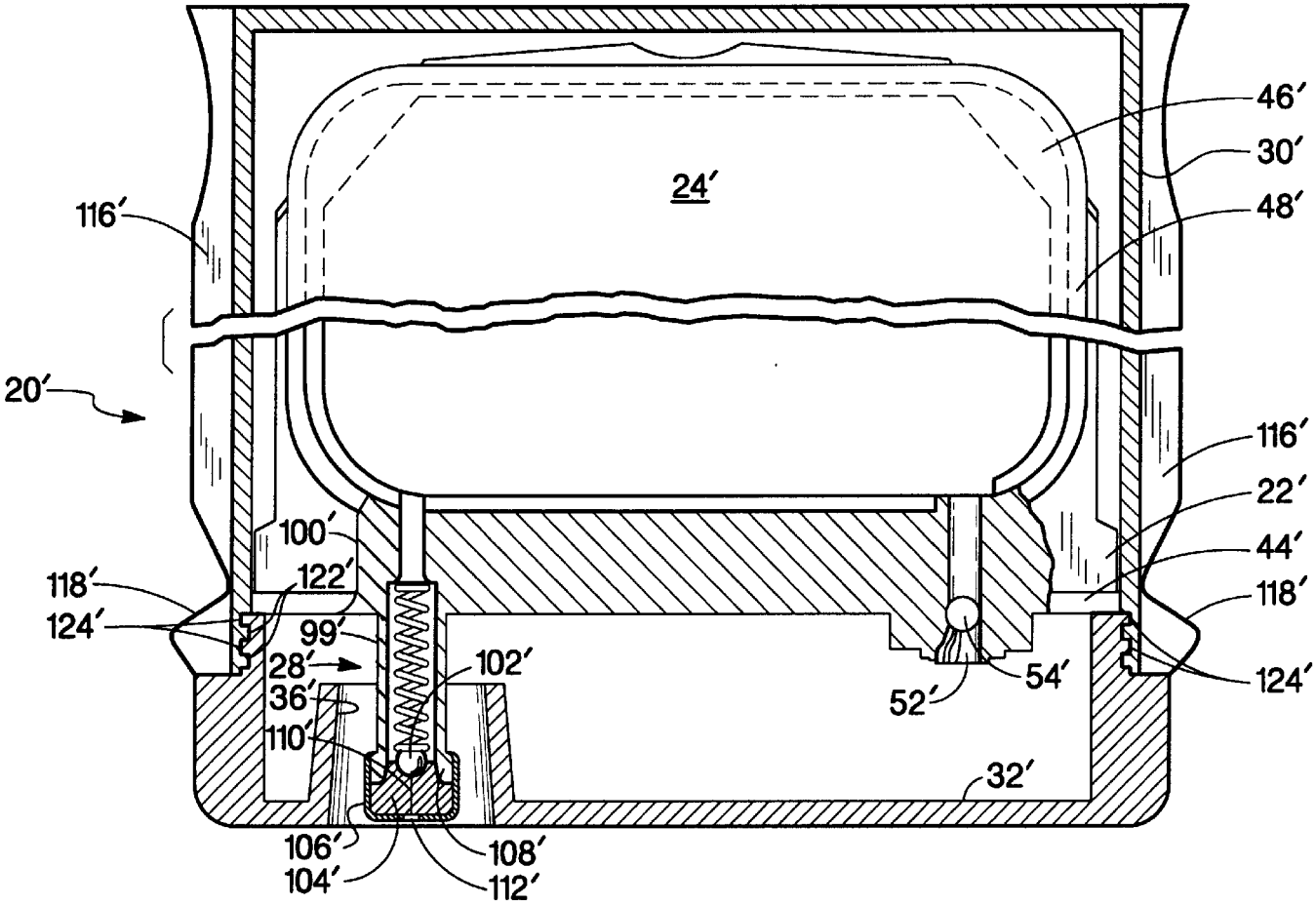
FIG. 5 is cross sectional view, taken along line 4—4 of FIG. 4, of a portion of the ink supply of FIG. 4.

As shown in FIGS. 4 and 5 the ink container 20' of the present invention includes a chassis 22' which carries an ink reservoir 24' for containing ink, and a fluid outlet 28' in fluid communication with the ink reservoir 24'. The chassis 22' is enclosed with a hard protective shell 30' having a cap 32' affixed to its lower end. The cap 32' is configured for engagement with an actuator associated with the printing apparatus.

In the preferred embodiment the reservoir 24' is formed by plastic sheets 50' which are heat staked to the faces 48' of the frame as discussed previously in respect to ink container 20. In addition, the fluid outlet 28' of the ink container of the present invention includes a septum 104' and a sealing ball 102' similar to the ink container 20 discussed previously.

With the ink container 20' of the present invention properly inserted into a docking bay of an ink-jet printer a fluid inlet (not shown) associated with the ink-jet printer engages the fluid outlet 28' associated with the ink container 20' to form a fluid connection between the ink-jet printer and the ink container 20'. Once fluid communication is established between the ink-jet printer and the ink container 20' fluid is drawn from the ink reservoir 24 to the ink-jet printhead by back pressure generated in the ink-jet printhead. Alternatively, the ink reservoir 24 may be pressurized in some manner such as use of a biasing force against the plastic sheets 50' of the ink reservoir 24' to provide a pressurized fluid flow to the ink-jet printhead if higher flow rates are desired. This can be done by positioning a compressed spring (not shown) between each sheet 50' and the hard protective shell 30'. The spring biases the pair of sheets toward each other to pressurize the ink reservoir 24'.

Figure 6A:
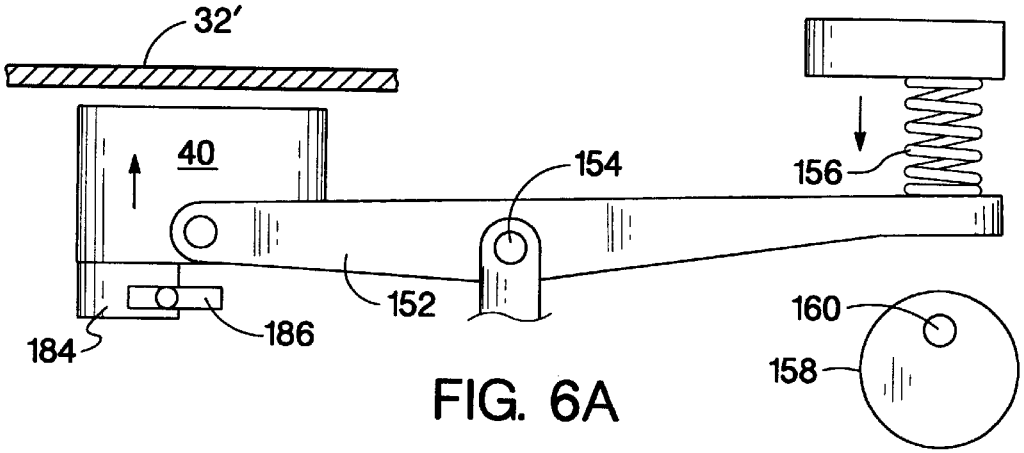
FIGS. 6A–6C are cross sectional views of a portion of the ink supply and docking bay showing the actuator and the actuator engagement device of the present invention for preventing generation of an out-of-ink signal based on actuator displacement.
Figure 6B:
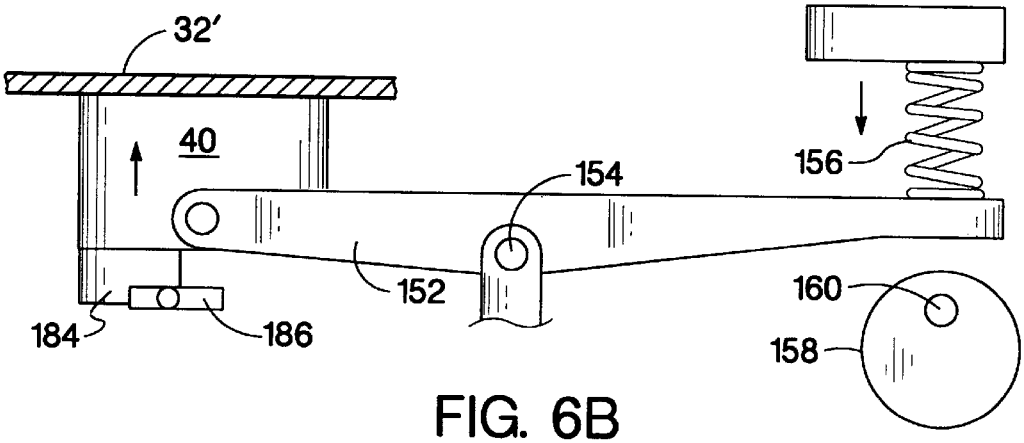
Figure 6C:
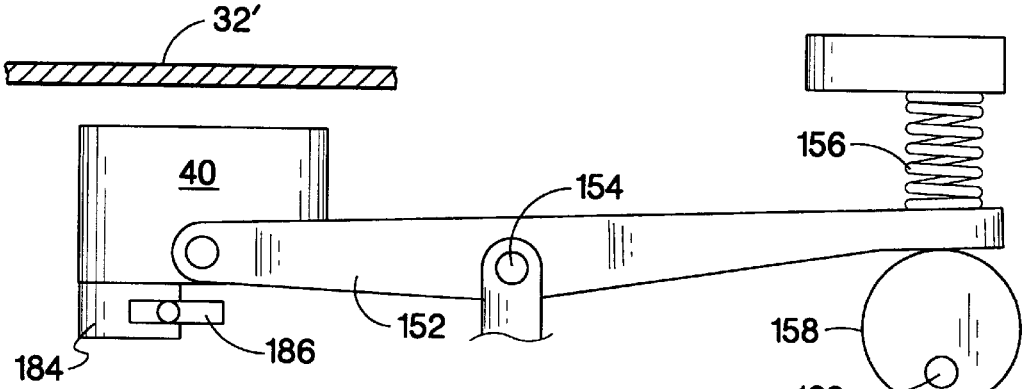

FIGS. 6A–6C are a representation of the ink supply 20' is inserted into the docking bay of an ink-jet printer. Upon insertion of the ink supply 20', the actuator 40 attempts to engage the pump 26 as previously discussed with respect ink container 20. Because the ink container 20' does not require the use of a pump the cap 32' has an engagement portion which engages the actuator 40 to prevent an out of ink signal FIG. 6A illustrates the actuator 40 moving towards the cap engagement portion 32'. The actuator 40 is urged toward the cap engagement portion 32' by the decompression of spring 156. As shown in FIG. 6B the actuator 40 engages the cap engagement portion 32' with the actuator 40 shown in its upper most position. The flag 184 blocks light beam from the sensor thereby preventing an out of ink signal from the ink-jet printer. The actuator 40 remains in the engagement position with cap 32' until the cam 158 is rotated back to its engagement position whereby the actuator 40 is disengaged from the engagement cap 32'. It can be seen that throughout the entire operation of the actuator 40 with the ink container 20' properly inserted into the docking bay the flag 184 prevents the light beam from reaching the sensor and thereby preventing the actuation of the optical sensor which initiates an out of ink signal as discussed previously with respect to ink container 20. In this manner, the ink container 20' of the present invention allows ink to be provided to the ink-jet printer without an out of ink signal being generated based on actuator position.

To prevent printhead damage resulting from an out of ink condition alternative out of ink indicators may be used such as drop counting to determine ink usage or some form of visual out of ink signal may be used such as a visual inspection of the ink container to determine ink level. Drop counting in described in more detail in co-pending U.S. patent application entitled "Ink Usage Management System" Ser. No. 08/706,045 filed on Aug. 30, 1996 which is assigned to the assignee of the present invention and incorporated herein by reference. The ink container 20' of the present invention is an alternative ink container that may be used in applications where these alternative ink level sensing method are adequate as well as for applications where the system does not require a pressurized supply of ink. Alternatively, the ink container 20' can be modified to provide a source of pressurized ink by providing a biasing member to engage the plastic sheets 50' and pressurize ink within the ink container 20'. The present invention allows more than one type of ink container 20 and 20' to be used with printers of the type which make use of actuator position for determining an out of ink condition.

What is claimed is:

1. A replaceable ink container for use with a printing apparatus having out of ink detection, the printing apparatus including a linear actuator for pressurizing ink and a fluid inlet for receiving pressurized ink, the replaceable ink container comprising:

a fluid reservoir having an outlet, the outlet configured for connection to the fluid inlet associated with the printing apparatus; and an actuator engagement device for engaging the linear actuator associated with the printing apparatus, the linear actuator is adapted to move between a first position wherein an out of ink signal is generated and a second position, the actuator engagement device disposed and arranged to engage the actuator to prevent movement of the actuator from the second position to the first position.

2. The replaceable ink container of claim 1 wherein the first position the actuator is extended from the printing device.

3. The replaceable ink container of claim 1 wherein the actuator engagement device is an ink container housing portion.

4. The replaceable ink container of claim 1 wherein the actuator engagement device is fixed.

5. The replaceable ink container of claim 1 wherein the actuator engagement device is a leading edge of a variable volume chamber.

6. The replaceable ink container of claim 1 wherein ink delivered by the ink container is substantially non-pressurized.

7. The replaceable ink container of claim 1 further including a sensor, the sensor associated with the actuator for monitoring the position of the actuator to detect when the actuator is in an extended position.

8. The replaceable ink container of claim 1 further including an ink usage monitor for determining an out of ink condition based on ink usage.

9. A method for providing ink to a printing apparatus having a fluid inlet for receiving ink and an actuator movable between a first position wherein an out-of-ink signal is generated and a second position, movement of the actuator produces an engagement with an expandable chamber associated with an ink container to bias the expandable chamber to supply ink to the fluid inlet, the method comprising:

coupling fluidically a fluid outlet in fluid communication with a supply of ink to the fluid inlet to allow ink to pass from the supply of ink to the fluid inlet; and engaging the actuator associated with the printing apparatus to prevent movement of the actuator from the second position to the first position thereby preventing an out of ink signal.

10. The method for providing ink to a printing apparatus of claim 9 wherein fluidically coupling the fluid outlet further includes pressurizing ink within the supply of ink to provide a pressurized supply of ink to the fluid inlet.

11. The method for providing ink to a printing apparatus of claim 9 wherein fluidically coupling the fluid outlet further includes drawing ink from the supply of ink with backpressure associated with a corresponding ink-jet printhead.

12. The method for providing ink to a printing apparatus of claim 9 further comprising monitoring ink availability in the reservoir based on ink usage.

13. The method for providing ink to a printing apparatus of claim 12 wherein monitoring ink availability includes counting ink drops ejected to determine ink usage.

14. The method for providing ink to a printing apparatus of claim 9 wherein engaging the actuator includes positioning an actuator stop proximate the actuator to prevent movement of the actuator to the first position.

15. The method for providing ink to a printing apparatus of claim 9 wherein prior to coupling fluidically the fluid outlet and engaging the actuator the method includes inserting an ink container into a supply station associated with the printing system.

16. The method for providing ink to a printing apparatus of claim 9 wherein the providing ink from the supply of ink to the fluid inlet is accomplished without pressurizing the supply of ink.

17. The method for providing ink to a printing apparatus of claim 9 wherein the engaging the actuator associated with the printing apparatus is performed by the engagement of the actuator with a leading edge portion of a variable volume chamber.

18. The method for providing ink to a printing apparatus of claim 9 wherein the engaging the actuator associated with the printing apparatus is performed by the engagement of the actuator with a fixed portion of the ink container.

19. An ink-jet printing system having a replaceable ink container and an actuator configured for engagement with a variable volume chamber associated with a pressurizable ink container, the actuator engaging the variable volume chamber for pressurizing ink within the chamber for transferring ink from the variable volume chamber to a corresponding printhead, the ink-jet printing system comprising:

a printing portion including a fluid inlet and an actuator, the ink inlet is configured for connection to an ink container fluid and the actuator is configured for engaging the variable volume chamber, the printing portion producing an out of ink signal based on actuator displacement;

an ink container portion including a fluid outlet and an actuator displacement limiter, the fluid outlet is configured for fluid coupling with the fluid inlet and the actuator displacement limiter is so disposed and arranged to engage the actuator and limit displacement such that an out of ink signal is not produced based on actuator displacement.

20. The ink-jet printing system of claim 19 further including an ink usage monitor for producing an out of ink signal based on ink usage.

21. The ink-jet printing system of claim 19, wherein the actuator displacement limiter is a leading edge of a variable volume chamber.

22. The ink-jet printing system of claim 19, wherein the actuator displacement limiter is a fixed portion of the ink container.

23. The ink-jet printing system of claim 19, wherein ink provided from the reservoir to the ink outlet is substantially non-pressurized.

* * * * *

UNITED STATES PATENT AND TRADEMARK OFFICE

CERTIFICATE OF CORRECTION

PATENT NO. : 5,844,580
DATED : December 1, 1998
INVENTOR(S) : John A. Barinaga, et. al.

It is certified that error appears in the above-indentified patent and that said Letters Patent is hereby corrected as shown below:

On the title page, item [73] Assignee should read—

Hewlett-Packard Company
Palo Alto, CA
--.

Signed and Sealed this

Tenth Day of April, 2001

*Attest:*

Nicholas P. Godici

NICHOLAS P. GODICI

*Attesting Officer*

*Acting Director of the United States Patent and Trademark Office*